US012729897B2

(12) United States Patent
Reuter

(10) Patent No.: US 12,729,897 B2
(45) Date of Patent: Sep. 8, 2026

(54) ICE MAKING ASSEMBLY VERTICAL DETECTION ARM

(71) Applicant: Haier US Appliance Solutions, Inc., Wilmington, DE (US)

(72) Inventor: Daryl Lee Reuter, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 91 days.

(21) Appl. No.: 18/756,697

(22) Filed: Jun. 27, 2024

(65) Prior Publication Data

US 2026/0002720 A1 Jan. 1, 2026

(51) Int. Cl.
*F25C 1/24* (2018.01)
*F25C 5/187* (2018.01)

(52) U.S. Cl.
CPC ..... *F25C 1/24* (2013.01); *F25C 5/187* (2013.01); *F25C 2700/02* (2013.01)

(58) Field of Classification Search
CPC ..... F25C 5/187; F25C 2700/02; F25C 1/24
See application file for complete search history.

(56) References Cited

U.S. PATENT DOCUMENTS

| | | | | |
|---|---|---|---|---|
| 5,768,900 | A * | 6/1998 | Lee | F25C 5/187 62/353 |
| 7,134,292 | B2 | 11/2006 | Oh | |
| 10,788,253 | B2 | 9/2020 | Bird | |
| 2012/0186288 | A1* | 7/2012 | Hapke | F25C 5/187 62/137 |
| 2015/0068224 | A1* | 3/2015 | Subera | F25C 5/187 62/340 |
| 2021/0310712 | A1* | 10/2021 | Park | F25C 5/182 |

FOREIGN PATENT DOCUMENTS

| | | | |
|---|---|---|---|
| KR | 20050026635 | A | 3/2005 |
| KR | 100781287 | B1 | 12/2007 |

* cited by examiner

*Primary Examiner* — David J Teitelbaum
(74) *Attorney, Agent, or Firm* — Dority & Manning, P.A.

(57) ABSTRACT

An ice making assembly for a refrigerator appliance includes an ice maker defining a top side, a bottom side, a front side, and a back side. The ice maker is configured to generate ice. The ice making assembly also includes an ice detection arm assembly. The ice detection arm assembly includes a mounting bracket coupled to the ice maker at a top side of the ice maker, and a first arm rotatably coupled to a bottom side of the ice maker. The first arm is configured to rotate around a vertical axis. The ice detection arm assembly also includes a second arm rotatably coupled to the mounting bracket. The second arm is configured to rotate around a lateral axis. The second arm is configured to rotate the first arm as the second arm rotates.

18 Claims, 7 Drawing Sheets

ICE MAKING ASSEMBLY VERTICAL DETECTION ARM

FIELD OF THE INVENTION

The present subject matter relates generally to ice making appliances, and more particularly to ice detection arms of ice making appliances.

BACKGROUND OF THE INVENTION

Ice makers, or ice making appliances, are commonly provided as stand-alone appliances, or may be incorporated within larger refrigerator appliances used to store food items in both commercial and residential applications. Typically, such ice making appliances are configured for the bulk production of ice where e.g., multiple pieces of ice are used to cool the same beverage or used to cool other food items. The individual pieces of ice may have different shapes and are typically relatively smaller in size (e.g., largest dimension of an individual piece might be 2 inches or less, or even 1 inch or less).

Typical ice making appliances incorporated within refrigerator appliances employ a horizontal traveling component, a detection arm, to detect the presence of ice in an ice storage bucket. However, problems may occur where the detection arm does not adequately detect the ice level in some scenarios. For example, in a scenario where the ice storage bucket is an ice drawer, movement of the drawer may cause ice to shift away from the detection arm's detection zone, causing the ice making appliance to detect a low ice level, even when the bucket is full. This may lead to overfilling of the ice bucket and overflowing ice escaping into the compartment, and possibly the floor, during the cycling of the ice drawer.

Accordingly, an ice making appliance that may detect the ice level when ice is shifted away from the horizontal detection arm's detection zone would be particularly beneficial.

BRIEF DESCRIPTION OF THE INVENTION

Aspects and advantages of the invention will be set forth in part in the following description, or may be obvious from the description, or may be learned through practice of the invention.

In one example aspect of the present disclosure, a refrigerator appliance is provided. The refrigerator appliance defines a vertical direction, a lateral direction, and a transverse direction. The refrigerator appliance includes a cabinet including a freezer chamber, and an ice making assembly provided within the freezing chamber. The ice making assembly includes an ice maker defining a top side, a bottom side, a front side, and a back side. The ice maker is configured to generate ice. The ice making assembly also includes an ice detection arm assembly. The ice detection arm assembly includes a mounting bracket coupled to the ice maker at a top side of the ice maker, and a first arm rotatably coupled to a bottom side of the ice maker. The first arm is configured to rotate around a vertical axis. The ice detection arm assembly also includes a second arm rotatably coupled to the mounting bracket. The second arm is configured to rotate around a lateral axis. The second arm is configured to rotate the first arm as the second arm rotates.

In another example aspect of the present disclosure, an ice making assembly for a refrigerator appliance is provided. The ice making assembly defines a vertical direction, a lateral direction, and a transverse direction. The ice making assembly includes an ice maker defining a top side, a bottom side, a front side, and a back side. The ice maker is configured to generate ice. The ice making assembly also includes an ice detection arm assembly. The ice detection arm assembly includes a mounting bracket coupled to the ice maker at a top side of the ice maker, and a first arm rotatably coupled to a bottom side of the ice maker. The first arm is configured to rotate around a vertical axis. The ice detection arm assembly also includes a second arm rotatably coupled to the mounting bracket. The second arm is configured to rotate around a lateral axis. The second arm is configured to rotate the first arm as the second arm rotates.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
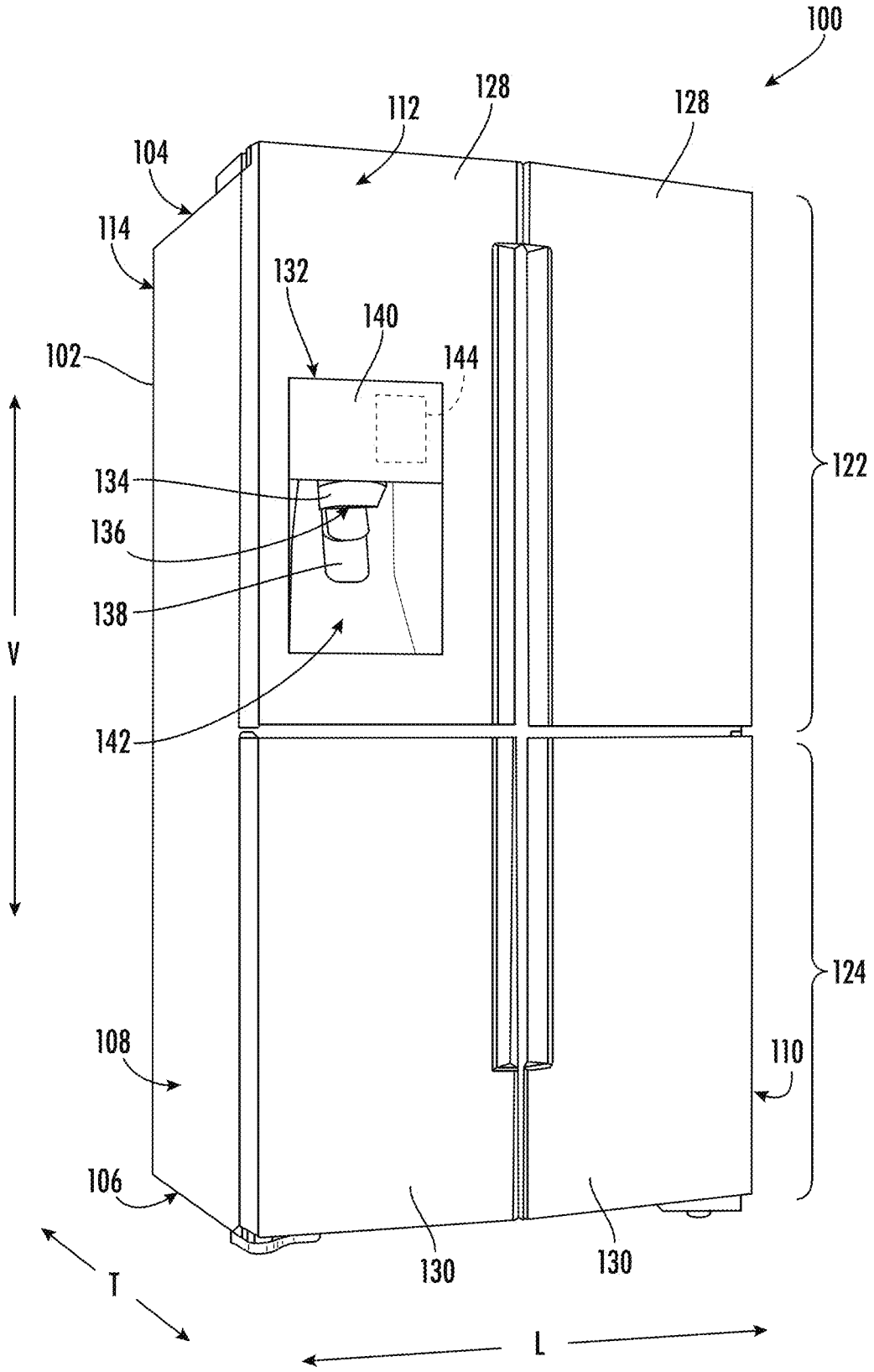
FIG. 1 provides a perspective view of a refrigerator appliance according to example embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may.

The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

FIG. 1 provides a perspective view of a refrigerator appliance 100 according to an example embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. Similarly, freezer doors 130 are rotatably hinged to an edge of housing 102 for selectively accessing freezer chamber 124. To prevent leakage of cool air, refrigerator doors 128, freezer doors 130, or housing 102 may define one or more sealing mechanisms (e.g., rubber gaskets, not shown) at the interface where the doors 128, 130 meet housing 102. Refrigerator doors 128 and freezer doors 130 are shown in the closed configuration in FIG. 1 and in the open configuration in FIG. 2. It should be appreciated that doors having a different style, position, or configuration are possible and within the scope of the present subject matter.

Refrigerator appliance 100 also includes a dispensing assembly 132 for dispensing liquid water or ice. Dispensing assembly 132 includes a dispenser 134 positioned on or mounted to an exterior portion of refrigerator appliance 100, e.g., on one of refrigerator doors 128. Dispenser 134 includes a discharging outlet 136 for accessing ice and liquid water. An actuating mechanism 138, shown as a paddle, is mounted below discharging outlet 136 for operating dispenser 134. In alternative example embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 128. In the example embodiment, dispenser recess 142 is positioned at a level that approximates the chest level of a user. According to an example embodiment, the dispensing assembly 132 may receive ice from an icemaker or icemaking assembly 300 disposed in a sub-compartment of the refrigerator appliance 100 (e.g., IB compartment 180).

Refrigerator appliance 100 further includes a controller 144. Operation of the refrigerator appliance 100 is regulated by controller 144 that is operatively coupled to or in operative communication with control panel 140. In one example embodiment, control panel 140 may represent a general purpose I/O ("GPIO") device or functional block. In another example embodiment, control panel 140 may include input components, such as one or more of a variety of electrical, mechanical, or electro-mechanical input devices including rotary dials, push buttons, touch pads, or touch screens. Control panel 140 may be in communication with controller 144 via one or more signal lines or shared communication busses. Control panel 140 provides selections for user manipulation of the operation of refrigerator appliance 100. In response to user manipulation of the control panel 140, controller 144 operates various components of refrigerator appliance 100. For example, controller 144 is operatively coupled or in communication with various components of a sealed system, as discussed below. Controller 144 may also be in communication with a variety of sensors, such as, for example, chamber temperature sensors or ambient temperature sensors. Controller 144 may receive signals from these temperature sensors that correspond to the temperature of an atmosphere or air within their respective locations.

In some embodiments, controller 144 includes memory and one or more processing devices such as microprocessors, CPUs, or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 144 may be constructed without using a microprocessor (e.g., using a combination of discrete analog or digital logic circuitry; such as switches, amplifiers, integrators, comparators, flip-flops, AND gates, and the like; to perform control functionality instead of relying upon software).

Figure 2:
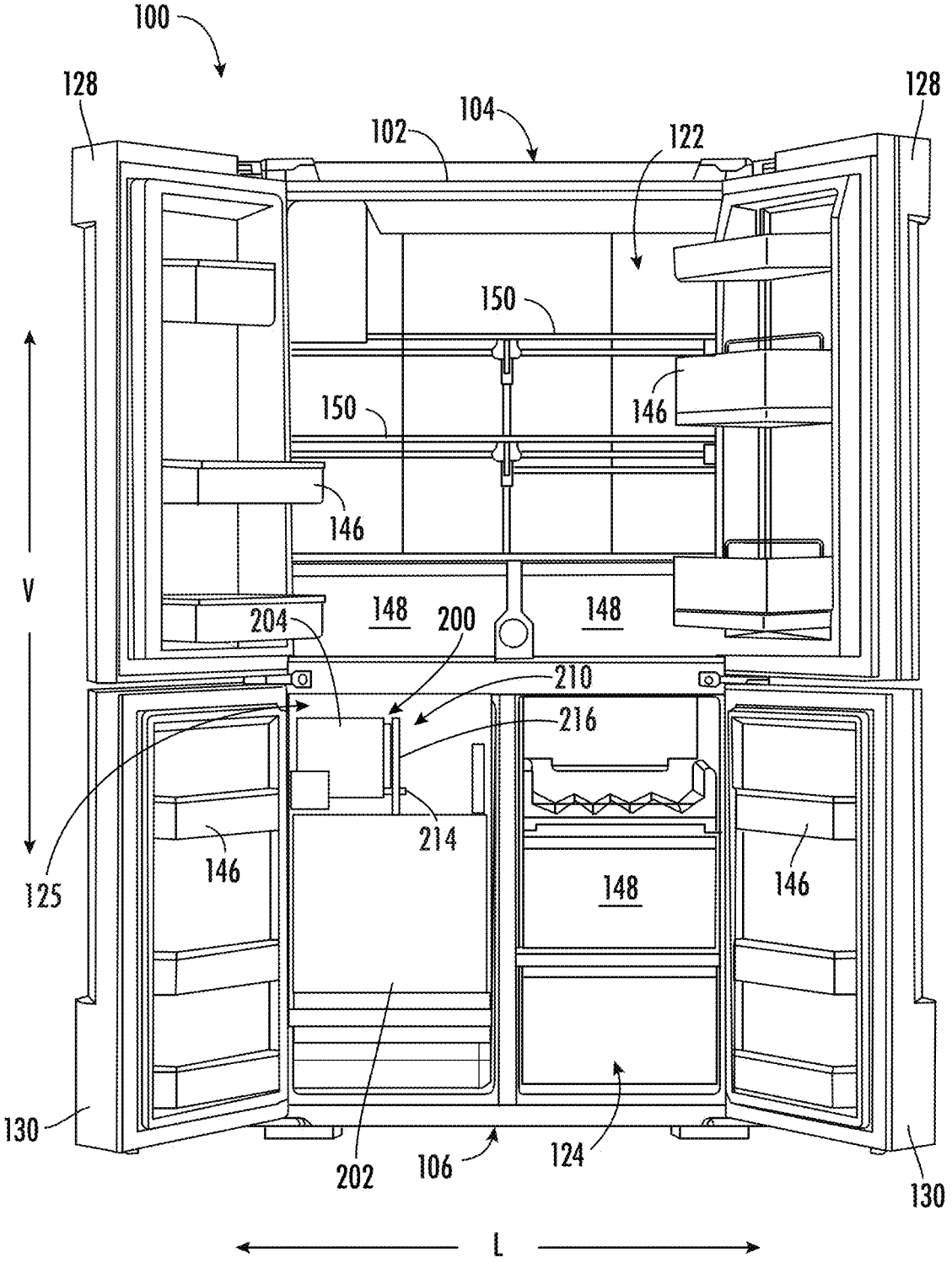
FIG. 2 provides a front view of the example refrigerator appliance of FIG. 1 with refrigerator and freezer doors in an open position.

FIG. 2 provides a front view of refrigerator appliance 100 with refrigerator doors 128 and freezer doors 130 shown in an open position. According to the illustrated embodiment, various storage components are mounted within fresh food chamber 122 and freezer chamber 124 to facilitate storage of food items therein as will be understood by those skilled in the art. In particular, the storage components include bins 146, drawers 148, and shelves 150 that are mounted within fresh food chamber 122 or freezer chamber 124. Bins 146, drawers 148, and shelves 150 are configured for receipt of food items (e.g., beverages or solid food items) and may assist with organizing such food items. As an example, drawers 148 can receive fresh food items (e.g., vegetables, fruits, or cheeses) and increase the useful life of such fresh food items.

FIGS. 3 through 8 illustrate an example embodiment of an ice making assembly 200 as may be used in refrigerator appliance 100 or another appliance configuration (including a dedicated ice making appliance) as discussed above. For example, ice making assembly 200 may be located in lower freezer chamber 124 as shown in FIG. 2. An ice bin 202 may generally be included for the collection of ice generated by ice maker 204.

Figure 3:
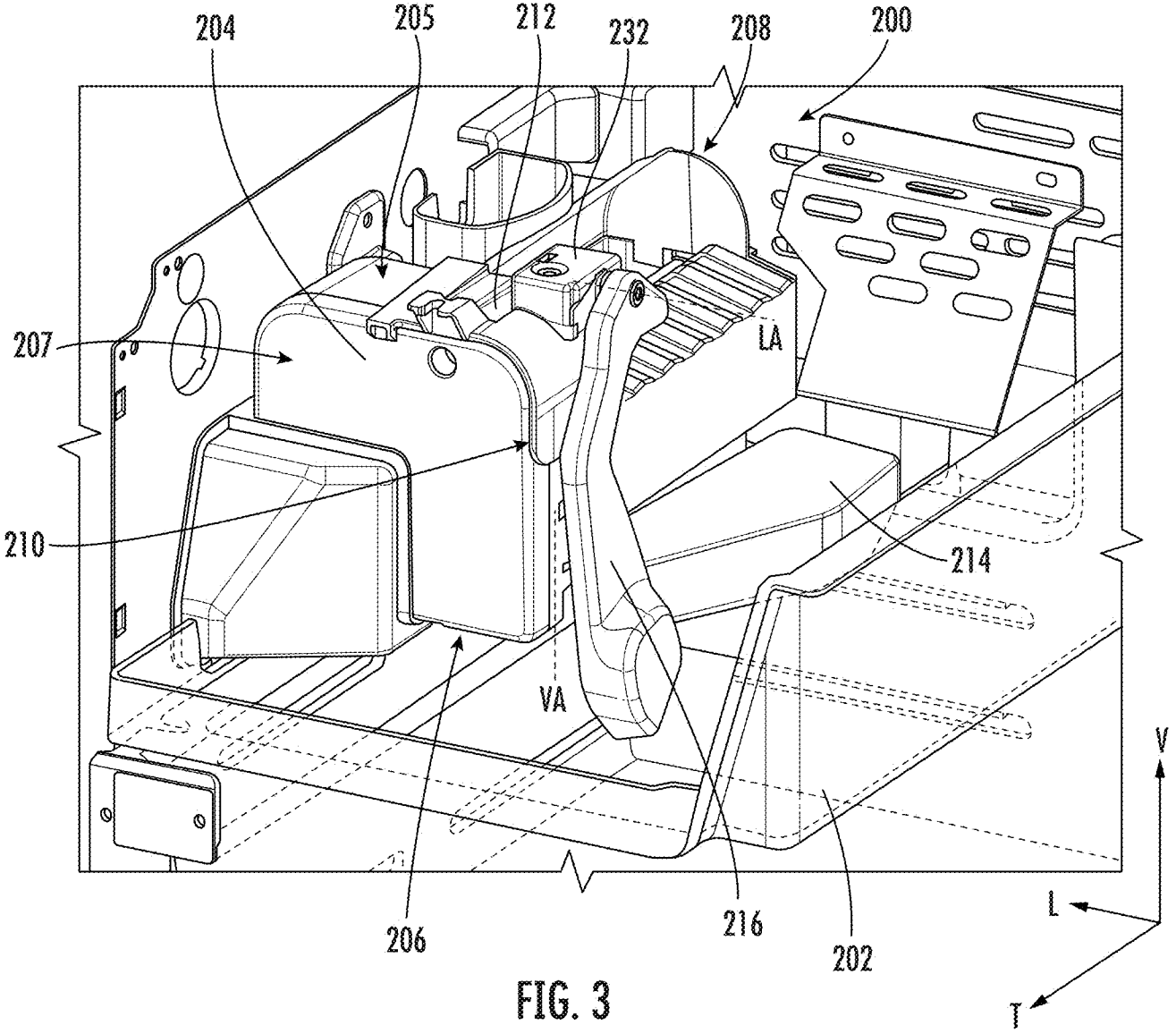
FIG. 3 provides a perspective view of an ice making assembly according to example aspects of the present disclosure.

As may be seen in FIG. 3, ice making assembly 200 may include an ice maker 204 including components such as a mold body (not shown) that defines a chamber or cavity in which liquid (e.g., water) may be supplied to form ice shapes (such as a crescent, sphere, block, cubed, etc.). It should be understood that the examples given herein and shown in the figures are not limiting, and that any suitably shaped ice mold may be implemented to form a wide variety of ice shapes. Additionally or alternatively, any suitable number of ice shape volumes may be implemented, and the disclosure is not limited to the examples given herein. In general, ice maker 204 may be defined between a top side 205, a bottom side 206, a front side 207, and a back side 208. In general, controller 144 may be in operable communication with ice maker 204, such that controller 144 may control the generation of ice from ice maker 204.

In general, ice making assembly 200 may include an ice detection arm assembly 210. In general, ice detection arm assembly 210 may include one or more arms configured to detect a full ice level condition of ice bin 202. In particular, the present example embodiment illustrates ice detection arm assembly 210 with two (2) arms, first arm 214 and second arm 216. In general, first arm 214 may be rotatably coupled to bottom side 206 of ice maker 204. For example, first arm 214 may be hinged to bottom side 206 of ice maker 204 such that first arm 214 may rotate around a vertical axis VA, such as rotating first arm 214 in a plane defined by the lateral direction L and the transverse direction T. In general, first arm 214 may be in signal communication with controller 144. In particular, first arm 214 may rotate to engage a switch (not shown) connected to controller 144. For example, in response to first arm 214 being engaged/rotated, e.g., rotated by ice accumulating within ice bin 202, the switch may be engaged and controller 144 may pause the generation of ice in order to reduce the overflow of ice from ice bin 202.

In general, second arm 216 may be mounted to ice maker 204 via a mounting bracket 212. Mounting bracket 212 may be generally coupled to ice maker 204 at top side 205 of ice maker 204. In general, second arm 216 may be rotatably coupled to mounting bracket 212, and may be configured to rotate around a lateral axis LA, such as rotating second arm 216 in a plane defined by the vertical direction V and the transverse direction T. In general, second arm 216 may rotate by contacting ice accumulating within ice bin 202. As such, second arm 216 may rotate and engage with first arm 214, e.g., second arm 216 may engage a contact side 215 of first arm 214, thereby rotating first arm 214 as second arm 216 rotates around the lateral axis LA. Accordingly, second arm 216 may engage first arm 214, thereby engaging the switch to signal controller 144 to pause the generation of ice from ice maker 204.

In general, FIGS. 4-8 may illustrate example aspects of embodiments of ice detection arm assembly 210. As may be seen in FIG. 4, second arm 216 may extend between a glide end 218 and a stopper end 220 in the vertical direction V, e.g., second arm 216 may extend in the plane defined by the vertical direction V and the transverse direction T. In general, second arm 216 may define a bend 222 between glide end 218 and stopper end 220. For example, second arm 216 may extend along a first axis FA from stopper end 220 toward glide end 218, where bend 222 may change the direction from which second arm 216 extends, e.g., second arm 216 may extend along a second axis SA to glide end 218. In particular, bend 222 between glide end 218 and stopper end 220 may be at an angle $\alpha$ between five degrees (5°) and sixty degrees (60°), such as between ten degrees (10°) and fifty degrees (50°), such as between fifteen degrees (15°) and forty degrees (40°). In general, bend 222 may improve the translation of second arm 216 over ice within ice bin 202 when ice bin 202 is removed from refrigerator appliance 100. Further, glide end 218 of second arm 216 may include a rounded tip 224 configured to glide over ice generated by ice maker 204, such as when ice bin 202 is removed from refrigerator appliance 100.

Figure 4:
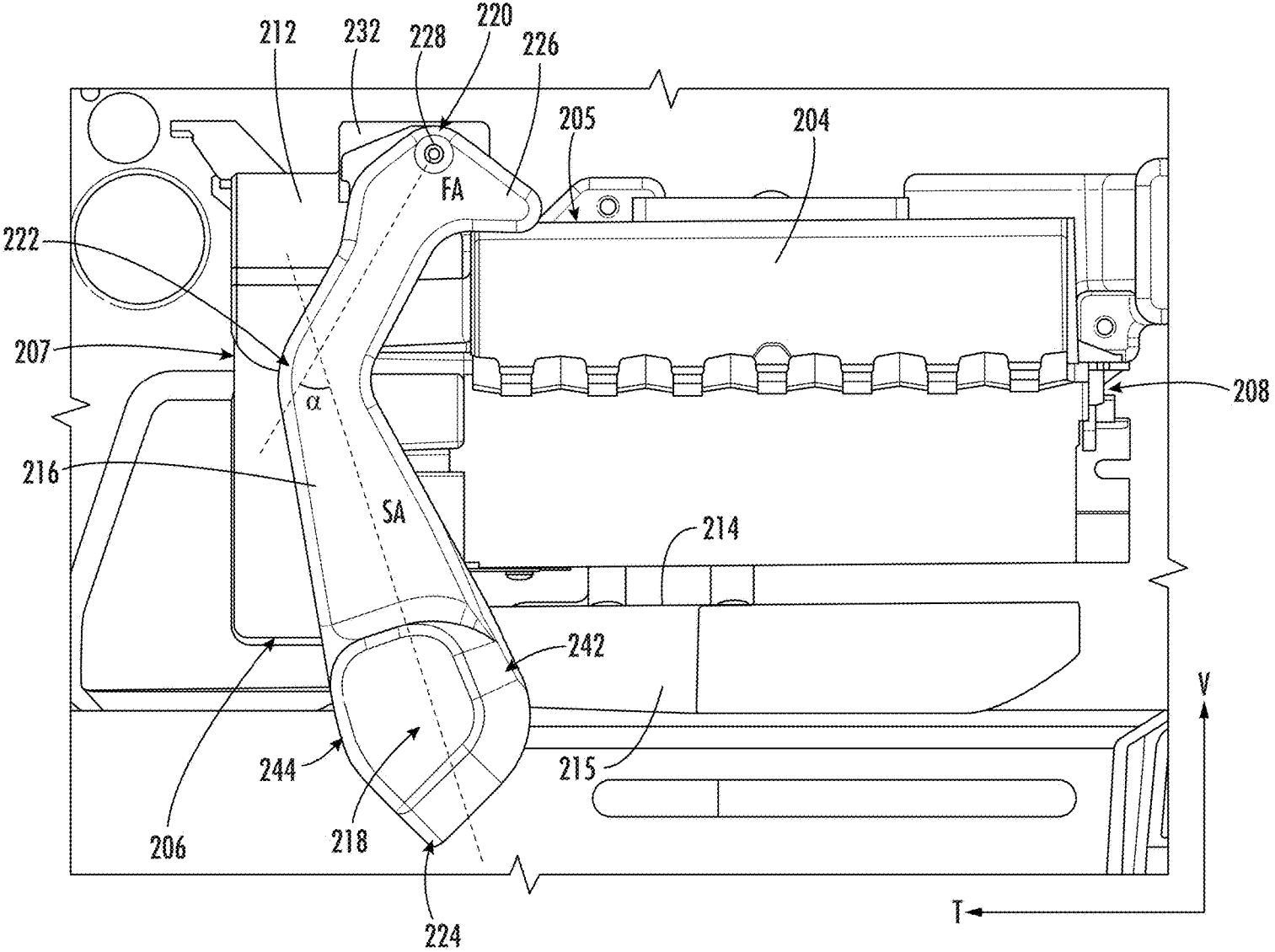
FIG. 4 provides a side view of the example ice making appliance of FIG. 3.

Referring still to FIG. 4, stopper end 220 of second arm 216 defines a protuberance 226 extending from second arm 216. For example, protuberance 226 may extend in the plane defined by the vertical direction V and the transverse direction T, approximately perpendicular first axis FA from stopper end 220 of second arm 216. In particular, protuberance 226 may rotate with second arm 216 and engage a top side 125 of freezer chamber 124, defining a predetermined range of rotation of second arm 216, such as rotating between twenty degrees (20°) and one hundred degrees (100°), such as between thirty degrees (30°) and ninety degrees (90°), such as between forty degrees (40°) and eighty degrees (80°).

Figure 8:
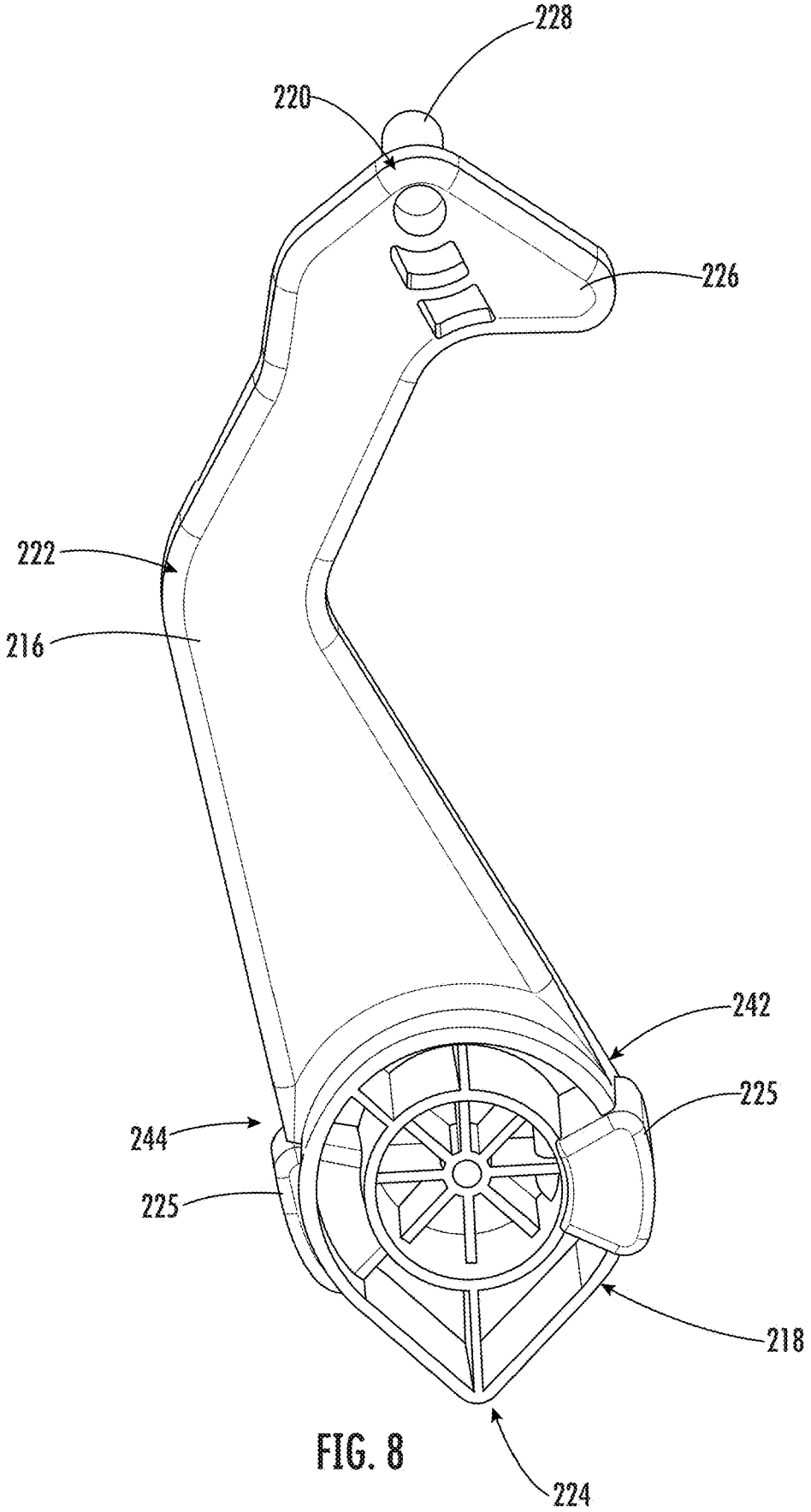
FIG. 8 provides a perspective view of an example embodiment of a second arm of the example ice making appliance of FIG. 3, according to example aspects of the present disclosure.

Turning ahead briefly to FIG. 8, illustrated is an example embodiment of second arm 216. In general, some example embodiments may include a bumper 225 positioned on second arm 216. In particular, glide end 218 of the second arm 216 of the present example embodiment includes two (2) bumpers 225, with one bumper 225 positioned on a top side 242 of second arm 216 and another bumper 225 positioned on a bottom side 244 of second arm 216. In general, example embodiments of second arm 216 may include one or more bumpers, such as one bumper 225 or more than three (3) bumpers 225, or no bumpers at all, e.g., some example embodiment may omit bumper(s) 225 entirely. In general, bumper(s) 225 may absorb impact from ice bin 202, or impact from ice within ice bin 202, as ice bin 202 is removed from, or reinserted into, refrigerator appliance 100.

Figure 5:
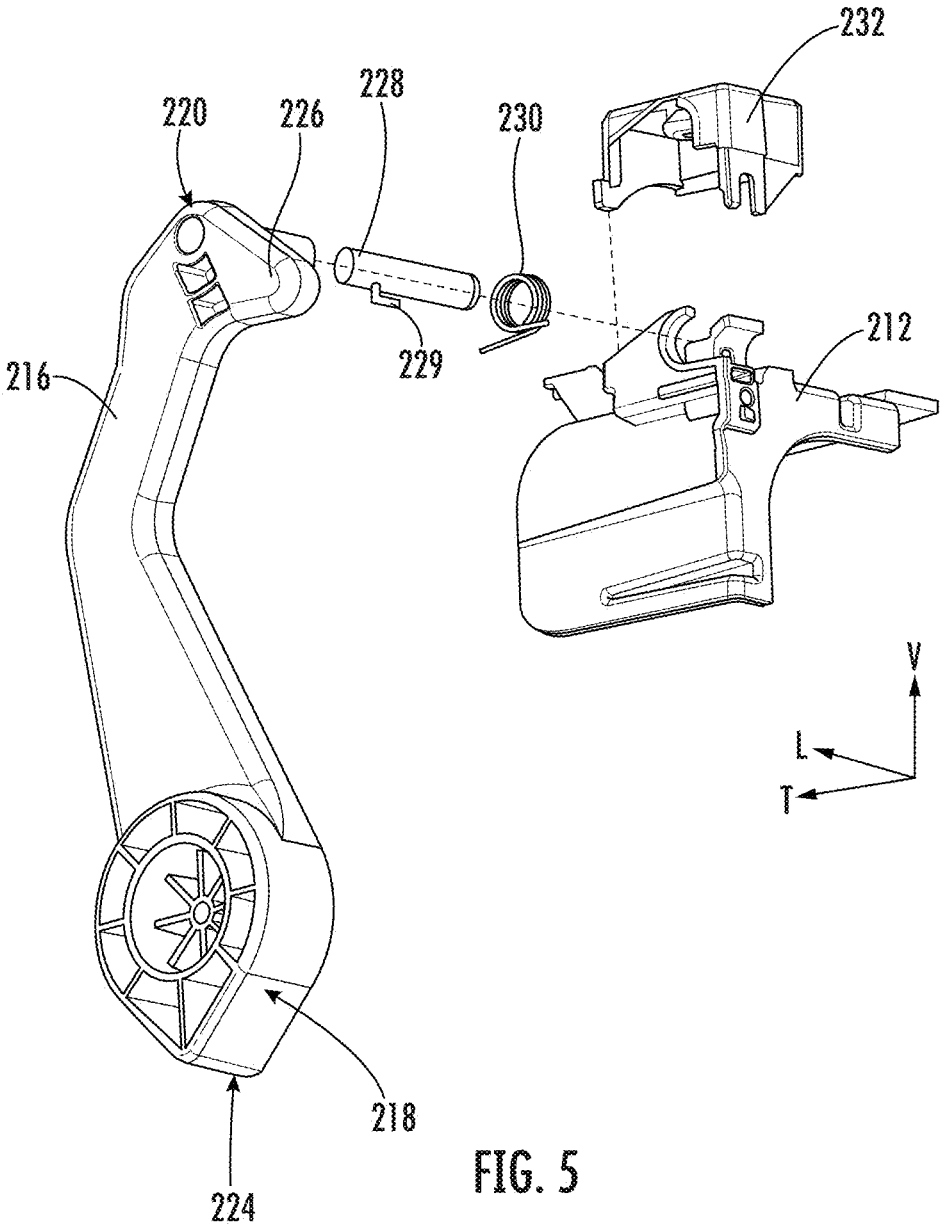
FIG. 5 provides an exploded view of components of the example ice making appliance of FIG. 3, according to example aspects of the present disclosure.

Turning now to FIG. 5, illustrated is an exploded view of second arm 216 rotatably coupling to mounting plate 212 of ice making assembly 200. In general, second arm 216 may include a pivot shaft 228. Some example embodiments may include pivot shaft 228 as a protrusion extending from stopper end 220 in the lateral direction L from second arm 216, and other example embodiments may include a separate pivot shaft 228, such as is shown in FIG. 5, which may generally couple to stopper end 220 of second arm 216. In general, pivot shaft 228 may rotatably couple second arm 216 to mounting bracket 212. In general, a cover 232 may be positioned over where pivot shaft 228 couples to mounting bracket 212. In general, cover 232 may insulate pivot shaft 228 so as to reduce lock-ups, e.g., freezing, of second arm 216.

Figure 6:
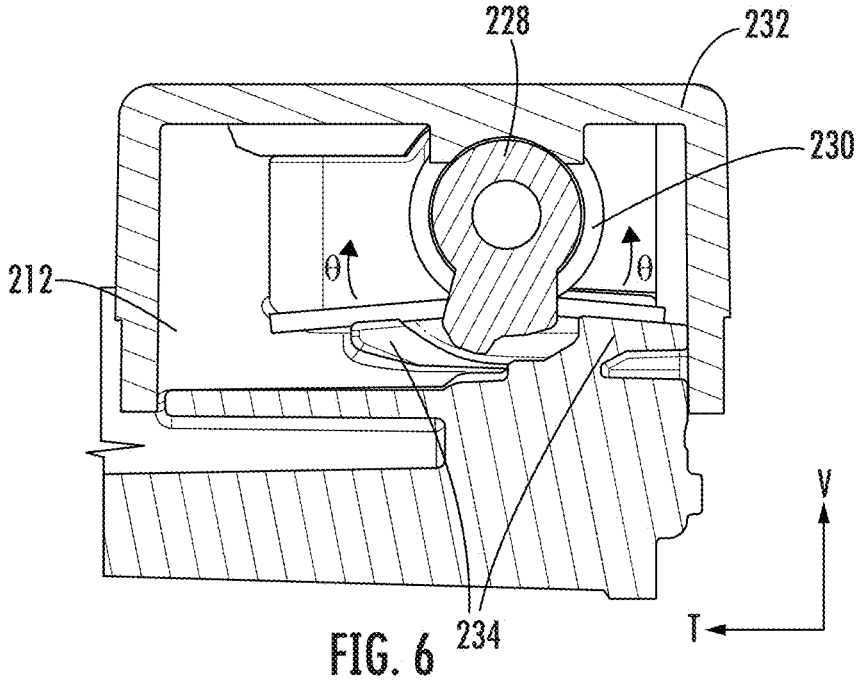
FIG. 6 provides a side, section view of a mounting plate of the example ice making appliance of FIG. 3, according to example aspects of the present disclosure.
Figure 7:
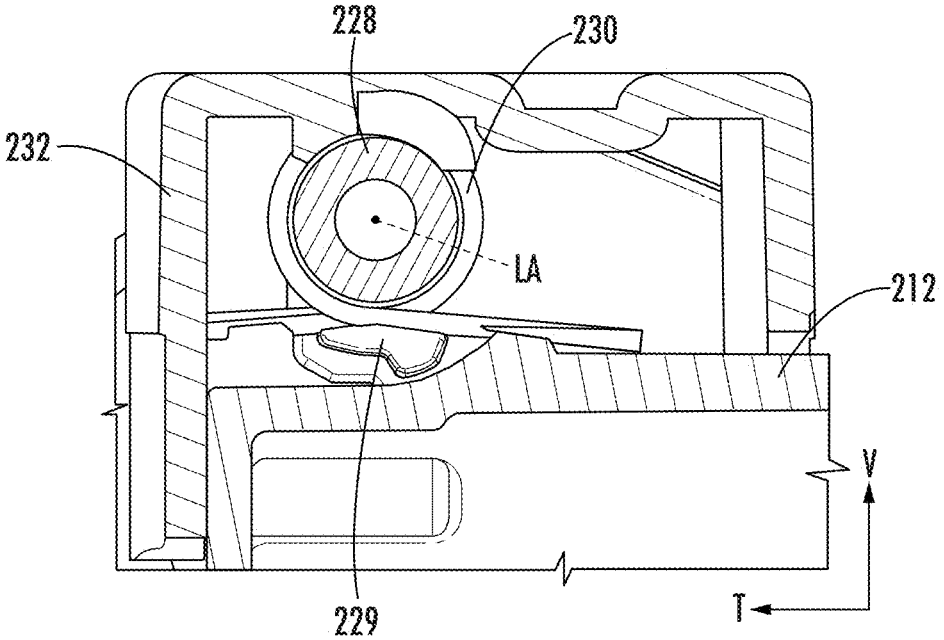
FIG. 7 provides a side, section view of a pivot shaft of the example ice making appliance of FIG. 3, according to example aspects of the present disclosure.

Referring now to FIGS. 6 and 7, a biasing member 230 may be positioned in mounting bracket 212. Biasing member 230 may generally engage pivot shaft 228, biasing second arm 216 generally downward in the vertical direction V. In general, biasing member 230 may be positioned within cover 232. As illustrated in FIGS. 6 and 7, biasing member 230 may be a torsion spring. In general, biasing member 230 is provided by way of example only and any other suitable spring or biasing element may be provided. In particular, the torsion spring may include extended ends configured to impart rotational force to pivot shaft 228 around the lateral axis LA (FIG. 7).

As may be seen in FIG. 6, mounting bracket 212 may define a retention ledge 234 generally configured to retain the tension spring, biasing member 230, at a specified preload deflection, i.e., angle θ. For example, the specified preload deflection, angle θ, may be between five degrees (5°) and forty degrees (40°), such as between ten degrees (10°) and thirty degrees (30°), such as between fifteen degrees (15°) and twenty-five degrees (25°). Additionally, as may be seen in FIG. 7, pivot shaft 228 may define a protrusion 229 configured to flex biasing member 230, the torsion spring, when second arm 216 rotates around the lateral axis LA. In particular, the specified preload deflection, angle θ, may bias second arm 216 downward in order to disengage first arm 214 when ice in ice bin 202 is less than full. Accordingly, when ice in ice bin 202 is less than full, second arm 216 may disengage first arm 214, thereby disengaging the switch in signal communication with controller 144, thereby resuming the generation of ice from ice maker 204.

As may be seen from the above, an ice making assembly may include a vertical ice detecting arm that pivots from a top of the ice making assembly on a horizontal axis. The vertical ice detecting arm may glides over full ice within an ice bin and may rotate into a horizontal ice detecting arm to its full bucket condition to shut off an ice maker. The vertical ice detecting arm incorporates a torsion spring that ensures the vertical arm returns to center/home position, i.e., a not full position, when ice level in the ice bin is less than full. A travel-limiting feature at the top of the vertical ice detecting arm may reduce the range of rotation of the arm, such as to reduce over traveling and landing on top of the horizontal arm.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet comprising a freezer chamber; and an ice making assembly provided within the freezing chamber, the ice making assembly comprising:

an ice maker defining a top side, a bottom side, a front side and a back side, the ice maker configured to generate ice; and an ice detection arm assembly, the ice detection arm assembly comprising:

a mounting bracket coupled to the ice maker at the top side of the ice maker, a first arm rotatably coupled to the bottom side of the ice maker, the first arm configured to rotate around a vertical axis, a second arm rotatably coupled to the mounting bracket, the second arm configured to rotate around a lateral axis, the second arm configured to rotate the first arm as the second arm rotates, the second arm extends between a glide end and a stopper end, the second arm defining a bend between the glide end and the stopper end, wherein the second arm comprises a pivot shaft one of extending from the stopper end of the second arm or coupled to the stopper end of the second arm, the pivot shaft rotatably couples the second arm to the mounting bracket, wherein a biasing member is positioned in the mounting bracket, the biasing member engaging the pivot shaft of the second arm, wherein the pivot shaft defines a protrusion configured to flex the biasing member when the second arm rotates, and wherein the mounting bracket defines a retention ledge configured to retain the biasing member at a specified preload deflection.

2. The refrigerator appliance of claim 1, wherein the glide end of the second arm comprises a rounded tip configured to glide over ice generated by the ice maker.

3. The refrigerator appliance of claim 1, wherein the glide end of the second arm comprises a bumper positioned on one or more of a top side and a bottom side of the second arm.

4. The refrigerator appliance of claim 1, wherein the stopper end of the second arm defines a protuberance extending from the second arm.

5. The refrigerator appliance of claim 1, wherein a cover is coupled to the mounting bracket, the cover positioned over the biasing member and the pivot shaft.

6. The refrigerator appliance of claim 1, wherein the biasing member is a torsion spring.

7. The refrigerator appliance of claim 1, wherein the first arm defines a contact side configured to receive the second arm, whereby the second arm engages and rotates the first arm as the second arm rotates.

8. The refrigerator appliance of claim 1, wherein, from the stopper end towards the glide end, the second arm extends along a first axis before the bend and the second arm extends along a second axis to the glide end.

9. The refrigerator appliance of claim 1, wherein the pivot shaft is a protrusion extending from the stopper end of the second arm.

10. An ice making assembly for a refrigerator appliance, the ice making assembly defining a vertical direction, a lateral direction, and a transverse direction, the ice making assembly comprising:

an ice maker defining a top side, a bottom side, a front side and a back side, the ice maker configured to generate ice; and an ice detection arm assembly, the ice detection arm assembly comprising:

a mounting bracket coupled to the ice maker at the top side of the ice maker, a first arm rotatably coupled to the bottom side of the ice maker, the first arm configured to rotate around a vertical axis, a second arm rotatably coupled to the mounting bracket, the second arm configured to rotate around a lateral axis, the second arm configured to rotate the first arm as the second arm rotates, the second arm extends between a glide end and a stopper end, the second arm defining a bend between the glide end and the stopper end, wherein the second arm comprises a pivot shaft one of extending from the stopper end of the second arm or coupled to the stopper end of the second arm, the pivot shaft rotatably couples the second arm to the mounting bracket, wherein a biasing member is positioned in the mounting bracket, the biasing member engaging the pivot shaft of the second arm, wherein the pivot shaft defines a protrusion configured to flex the biasing member when the second arm rotates, and wherein the mounting bracket defines a retention ledge configured to retain the biasing member at a specified preload deflection.

11. The ice making assembly of claim 10, wherein the glide end of the second arm comprises a rounded tip configured to glide over ice generated by the ice maker.

12. The ice making assembly of claim 10, wherein the glide end of the second arm comprises a bumper positioned on one or more of a top side and a bottom side of the second arm.

13. The ice making assembly of claim 10, wherein the stopper end of the second arm defines a protuberance extending from the second arm.

14. The ice making assembly of claim 10, wherein a cover is coupled to the mounting bracket, the cover positioned over the biasing member and the pivot shaft.

15. The ice making assembly of claim 10, wherein the biasing member is a torsion spring.

16. The ice making assembly of claim 10, wherein the first arm defines a contact side configured to receive the second arm, whereby the second arm engages and rotates the first arm as the second arm rotates.

17. The ice making assembly of claim 10, wherein, from the stopper end towards the glide end, the second arm extends along a first axis before the bend and the second arm extends along a second axis to the glide end.

18. The ice making assembly of claim 10, wherein the pivot shaft is a protrusion extending from the stopper end of the second arm.

* * * * *